US005138765A

United States Patent [19]

Watson et al.

[11] Patent Number: 5,138,765

[45] Date of Patent: Aug. 18, 1992

[54] METHOD OF MAKING AN ENHANCED HYDRAULICALLY EXPANDED HEAT EXCHANGER

[75] Inventors: George B. Watson, Alliance; Jamal Righi, North Canton, both of Ohio

[73] Assignee: The Babcock & Wilson Company, New Orleans, La.

[21] Appl. No.: 666,276

[22] Filed: Mar. 7, 1991

[51] Int. Cl.[5] ..... B23P 15/26

[52] U.S. Cl. ..... 29/890.042; 29/463; 29/890.039; 29/457

[58] Field of Search ..... 29/890.037, 890.039, 29/890.042, 890.036, 421.1, 463; 228/157

[56] References Cited

U.S. PATENT DOCUMENTS

| | | | |
|---|---|---|---|
| 2,982,013 | 5/1961 | Adams | 29/890.042 |
| 3,140,532 | 7/1964 | Adams | 29/890.042 |
| 3,147,545 | 9/1964 | Valyi | 29/890.042 |
| 3,200,480 | 8/1965 | Heuer | 29/890.042 |
| 3,201,858 | 8/1965 | Valyi | 29/890.042 |
| 3,340,589 | 9/1967 | Jaeger | 29/890.042 |
| 3,831,246 | 8/1974 | Morris | 29/890.42 |
| 4,231,423 | 11/1980 | Haslett | 165/105 |
| 4,295,255 | 10/1981 | Weber | 29/890.37 |

FOREIGN PATENT DOCUMENTS

| | | | |
|---|---|---|---|
| 2349355 | 4/1974 | Fed. Rep. of Germany | 29/890.036 |
| 0011218 | 1/1990 | Japan | 29/890.036 |
| 2159732 | 12/1985 | United Kingdom . | |

OTHER PUBLICATIONS

Watson, G. B. et al., "Critical Heat Flux in Inclined and Vertical Smooth and Ribbed Tubes", 5th International Heat Transfer Conference, Kyoto, Japan, Sep. 3-7, 1974.

R & D Proposal 88-233, prepared for Defense Advanced Research Projects Agency (DARPA), Sep. 20, 1988.

Purchase Order WPP52002—Navel Underwater Systems.

*Primary Examiner*—Irene Cuda

*Attorney, Agent, or Firm*—Vytas R. Matas; Robert J. Edwards; Daniel S. Kalka

[57] ABSTRACT

A method for manufacturing a ribbed flow channel (38) results in enhancing the heat transfer performance of a hydraulically expanded heat exchanger such as a coiled tube boiler (10). The ribs are machined or rolled into a flat metal sheet (20) prior to forming a cylinder. One cylinder (28) is rolled so that the ribs are located inside the cylinder while the other cylinder (32) is rolled with the ribs located on the outside. Cylinder (32) is positioned inside cylinder (28) and electron beam welded to form a helical weld path (16). A pressure fitting (34) is attached to the welded cylinder (36) and hydraulic pressure (P) is applied to deform the cylinders (28, 32) between the helical weld path thus creating a ribbed flow channel (38).

18 Claims, 7 Drawing Sheets

METHOD OF MAKING AN ENHANCED HYDRAULICALLY EXPANDED HEAT EXCHANGER

BACKGROUND OF THE INVENTION

1. Field of the Invention

The present invention relates in general to a method of manufacturing a ribbed flow channel and, in particular, to a method for enhancing the heat transfer performance of a heat exchanger such as a coiled tube boiler manufactured with a hydraulic expansion technique.

2. Description of the Related Art

There are a variety of power sources operating from heat derived in the oxidation of metallic lithium, for example, U.S. Pat. Nos. 3,964,416 and 4,634,479. U.S. Pat. No. 3,964,416 converts this energy to steam to drive a turbine for propulsion of underwater vehicles. In such devices, it is desirable not to exhaust the products of combustion into the sea.

The Stored Chemical Energy Propulsion System (SCEPS) as disclosed therein employs a lithium-fueled boiler which supplies steam to a turbine. The turbine is connected to a gearbox that drives the propulsor. The boiler consists of two helical coils, an inner and an outer arranged to provide an annular cylindrical cavity for the lithium fuel. Each helical coil is fabricated from stainless steel tubing that is coiled and welded to form the inner and outer containment walls of the boiler. The heat source in the boiler is a result of an exothermic chemical reaction between lithium fuel and injected sulfur hexafluoride ($SF_6$) which acts as the oxidant. The heat generated by the exothermic reaction is transferred from the lithium-fuel side of the boiler to the inside of the tubing and converts feedwater into steam.

Hydraulic expansion manufacturing techniques are known for creating flow channels. U.S. Pat. No. 4,295,255 issued to Weber describes a method of manufacturing a cooling jacket assembly for a control rod drive mechanism. This technology has further been applied to creating a flow channel as depicted in FIG. 1 and is referred to hereinafter as a coiled-tube boiler. The flow channel finds particular utility for both the inner and outer helical coils of the SCEPS boiler as depicted in FIG. 2. To fabricate a flow channel (inner or outer helical coil), one cylinder (12) is placed inside another cylinder (14) and an electron beam welder (not shown) spirally welds in a helical weld path (16) the two cylinders (12, 14) together. After welding, hydraulic pressure is applied between the welds (16) of the two cylinders (12, 14). As the hydraulic pressure increases, the cylinders (12, 14) deform between the helical weld paths (16) creating a flow channel (18) as is illustrated in FIG. 1.

It is also known in the art that internal ribs in tubes increase heat transfer performance as disclosed in U.S. Pat. Nos. 3,088,494 and 4,044,797. These ribs are provided in the tubes after the tube is formed by a milling, machining, drawing or swaging processes known in the art.

There are tubes of very hard materials such as Inconel 625 which are extremely difficult to provide ribs in. Also, it can be very costly to form ribs in long sections of tubing. Moreover, in small diameter tubing, it is difficult and sometimes not even practical to form ribs therein.

The prior art manufacturing processes are not suitable for forming ribs in the coiled tube boiler shown in FIG. 1 due to the nonuniform diameter of the flow channel (18).

Thus there is a need for a method for manufacturing a ribbed flow channel for enhancing the heat transfer performance of a coiled tube boiler and other hydraulically expanded heat exchangers. It is desireable that the method allow fabrication of ribs in hard materials and small diameter tubing.

SUMMARY OF THE INVENTION

The present invention solves the above-mentioned problems as well as others in the art by providing a method of manufacturing a ribbed flow channel which is simple, inexpensive, and employs a hydraulic expansion manufacturing technique.

The method of the present invention includes machining two flat sheets of metal to form ribs therein. The first metal sheet is rolled so as to be cylindrical in shape with a longitudinal seam. This first metal sheet is rolled so that the ribs situated therein are positioned inside the cylindrical shape. The second metal sheet is also rolled so as to form a cylindrical shape with a longitudinal seam. In the second metal sheet, the ribs situated therein are on the outside of the cylindrical shape. Further, the second metal sheet which is rolled into a cylindrical shape is adapted to fit inside the first cylindrical shape by mating the ribs of the two sheets to minimize the gap between them. Both longitudinal seams are welded to complete the cylinders. The second cylinder is positioned concentrically inside the first cylinder and then welded together by a high speed welding process such as electron-beam welding in a helical weld path. Both ends of the welded integral cylinder are closed with circle seam welds. A pressure fitting is attached to one end so as to be in communication with the helical weld path. Hydraulic pressure is applied between the helical weld paths through the pressure fitting to deform the first and second cylinders between the helical weld paths thus creating a ribbed flow channel or passageway.

Alternatively, two metal tubes may be fitted as a first and second cylinder as previously described. However, in this embodiment the ribs are formed on the inside of the first cylinder and on the outside of the second cylinder.

Accordingly, an aspect of the present invention is to provide a method of manufacturing a ribbed flow channel which is simple and inexpensive.

Another aspect of the present invention is to enhance the heat transfer performance of a hydraulically expanded heat exchanger such as a coiled tube boiler.

Still another aspect of the present invention is to provide a method for forming ribs in hard materials or small diameter flow channels which is inexpensive and easy to perform.

A further aspect of the present invention is to provide a hydraulically expanded boiler flow channel for a SCEPS boiler which results in the use of thinner sheet of high strength metal to maintain the pressure boundary while simultaneously reducing the weight of the boiler.

Advantageously, the present invention provides exotic and/or extremely high strength materials with internal ribs for the SCEPS boiler.

The various features of novelty characterized in the invention are pointed out with particularity in the claims annexed to and forming a part of this disclosure.

For a better understanding of the invention, and the operating advantages attained by its use, reference is made to the accompanying drawings and descriptive matter in which the preferred embodiment of the invention is illustrated.

DESCRIPTION OF THE PREFERRED EMBODIMENT

Figure 1:
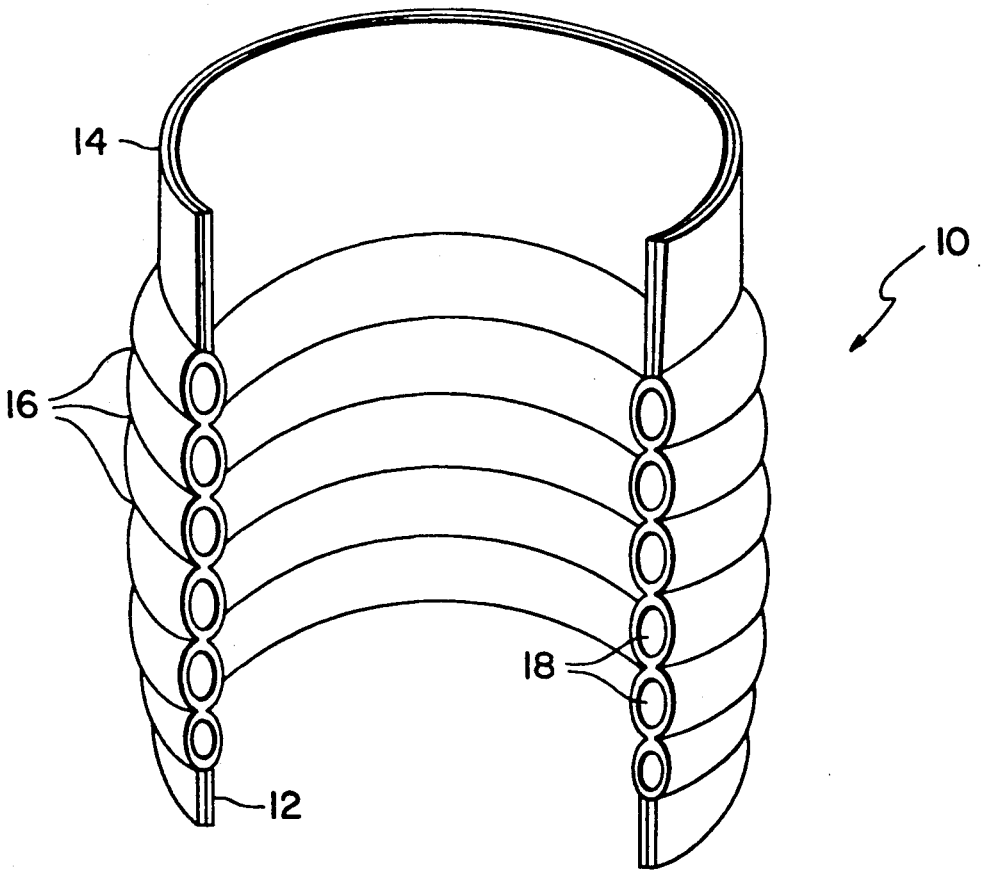
FIG. 1 PRIOR ART
FIG. 1 is a perspective view with a cross-sectional portion removed of a hydraulically expanded flow channel known in the art.
Figure 2:
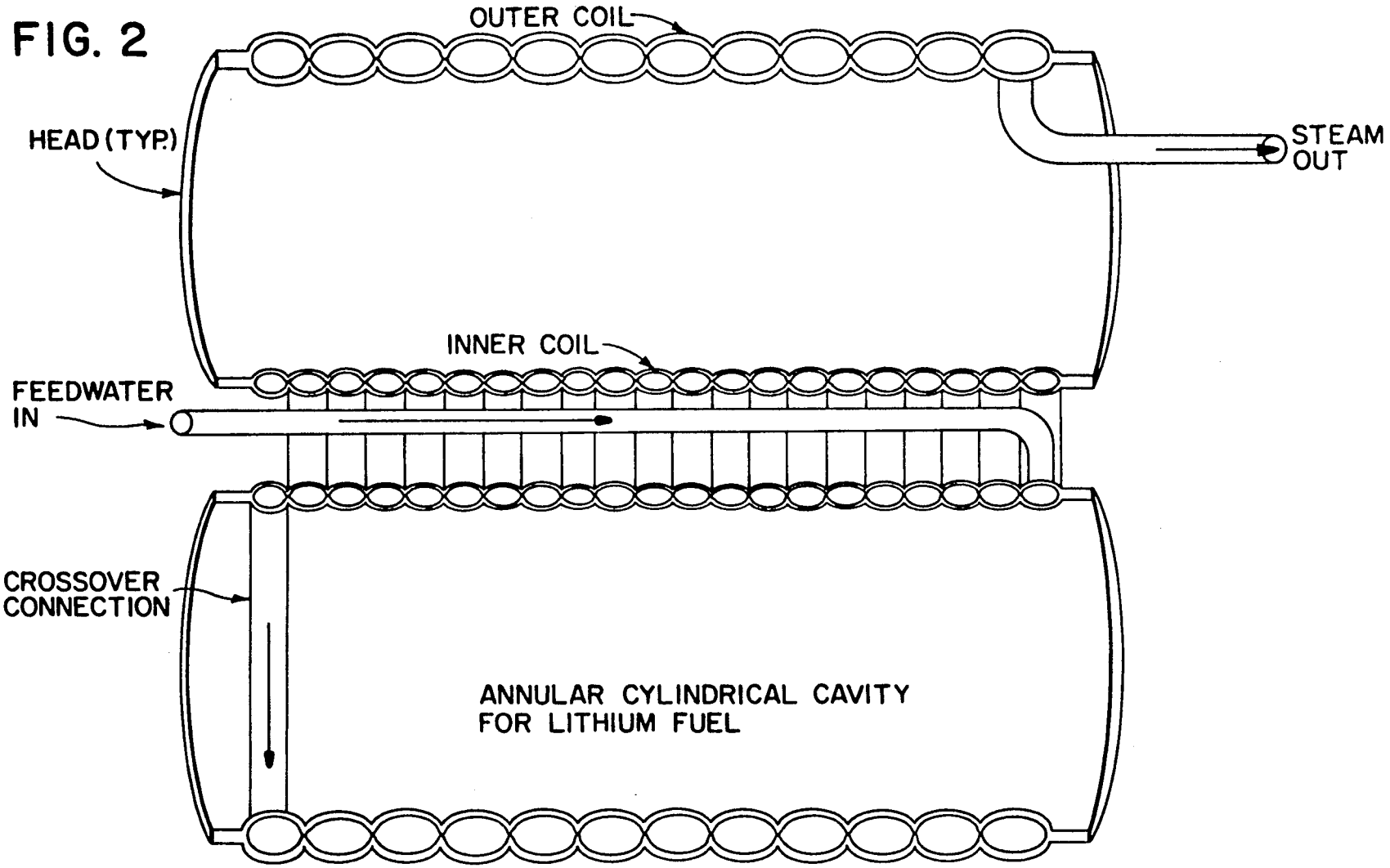
FIG. 2 is a perspective view of SCEPS boiler.
Figure 3:
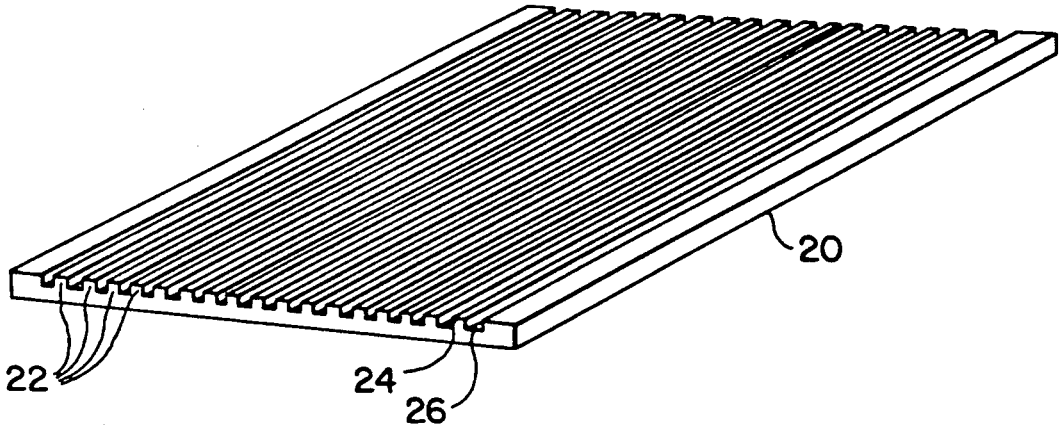
FIG. 3 is a perspective view of a flat metal sheet with ribs formed therein.

The present invention resides in a method for providing ribs in heat exchangers fabricated with a hydraulic expansion manufacturing technique such as the coiled tube boiler (10) shown in FIG. 1. In fabricating the coiled tube boiler (10), one cylinder (12) is placed inside a second cylinder (14). A high speed welding process, such as electron beam welding, welds in a spiral weld path (16) the two cylinders (12, 14) together. After welding, a pressure fitting (not shown) is attached and hydraulic pressure is applied between the welds (16) and the two cylinder sheets (12, 14). As the hydraulic pressure is slowly increased, the cylinders (12, 14) deform between the helical welds (16) to create a flow channel (18) therebetween. The manufacturing parameters are taught in U.S. Pat. No. 4,295,255 which is assigned to the present Assignee and is hereby incorporated by reference.

Figure 7:
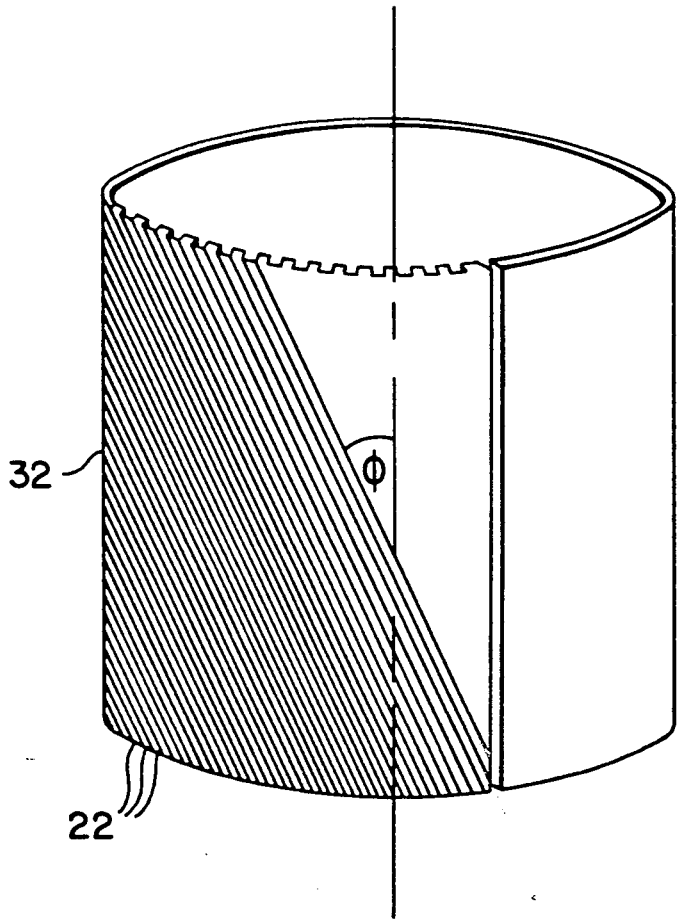
FIG. 7 is a perspective view of the second cylinder according to the present invention illustrating a preset angle $\phi$ to the longitudinal axis.
Figure 8:
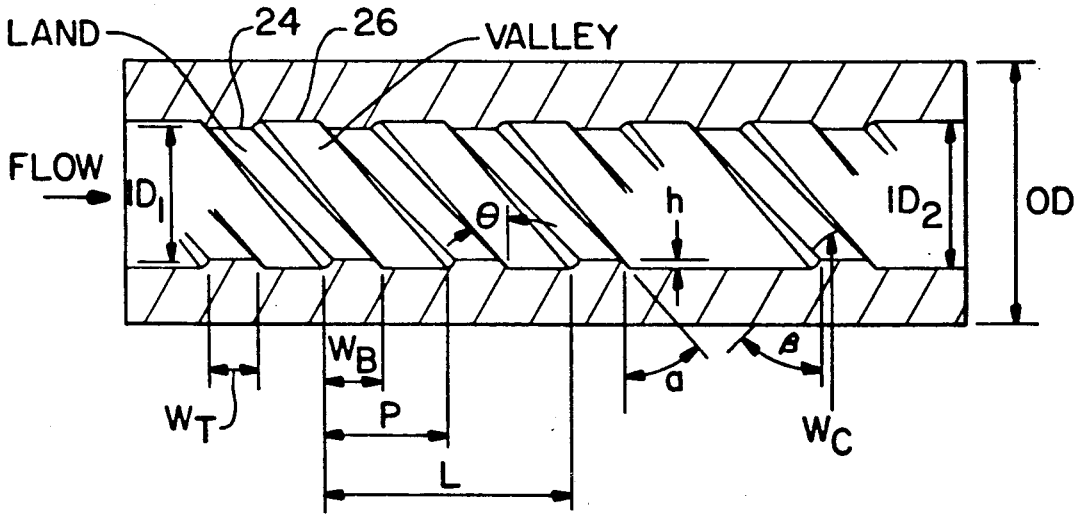
FIG. 8 is a cross-sectional illustration of a portion of the flow channel depicting the ribbed configuration.

The method of the present invention is directed to enhancing the heat transfer performance of hydraulically expanded heat exchangers such as the coiled tube boiler (10). Referring to FIGS. 3-8, a flat sheet of metal (20) is machined or rolled in a known fashion so as to form ribs (22) therein. The ribs (22) consist of an elevated portion referred to as a land (24) and a lowered portion referred to as a valley (26) as best seen in FIG. 8. The term "ribs" (22) as employed herein is meant to include any form of surface roughness such as dimples, grooves, coarse or fine knurling as illustrated in these Figures which have a "raised" and a "lower" portion.

Figure 4:
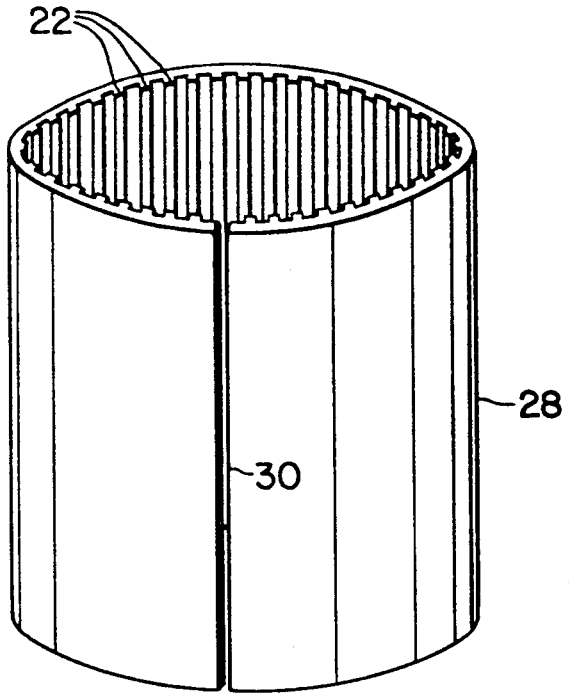
FIG. 4 is a perspective illustration of a rolled metal sheet with the ribs situated inside.
Figure 5:
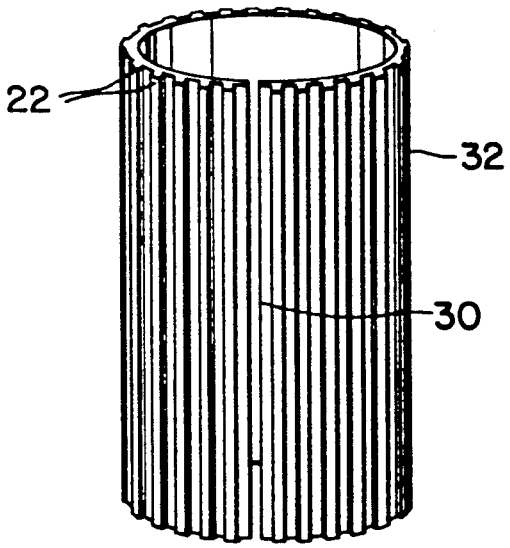
FIG. 5 is a view similar to FIG. 4 with the ribs situated outside.

Next, referring to FIGS. 4 and 5, two flat metal sheets (20) are rolled to form cylinders (28, 32). The first flat metal sheet (20) is rolled to form a cylinder (28) having a longitudinal seam (30). The cylinder (28) is rolled in a fashion so that the ribs (22) are located inside the cylinder (28).

The second flat metal sheet (20) is rolled to form a second cylinder (32) with a longitudinal seam (30) but the second cylinder (32) is rolled so that the ribs (22) are located on the outside of the cylinder (32). Cylinder (32) is also rolled so that it has a smaller diameter than cylinder (28) which allows it to fit concentrically within the first cylinder (28). Prior to placing cylinder (32) within cylinder (28), the longitudinal seam (30) of both cylinders (28, 32) is welded to complete the cylinders (28, 32). The equipment used for rolling the flat metal sheets (20) is well known in the art.

Preferably, the second cylinder (32) is positioned inside the first cylinder (28) relative to each other so that the lands (24) on one cylinder are opposite the valleys (26) on the other cylinder. The inner cylinder (32) is deformed radially so as to obtain a tight mechanical fit with the other cylinder (28).

A high-speed welding process such as electron-beam welding is used to weld with a spiral weld (16) the two cylinders (28, 32) together. The ends of the cylinders (28, 32) are closed with circle seam welds.

Figure 6:
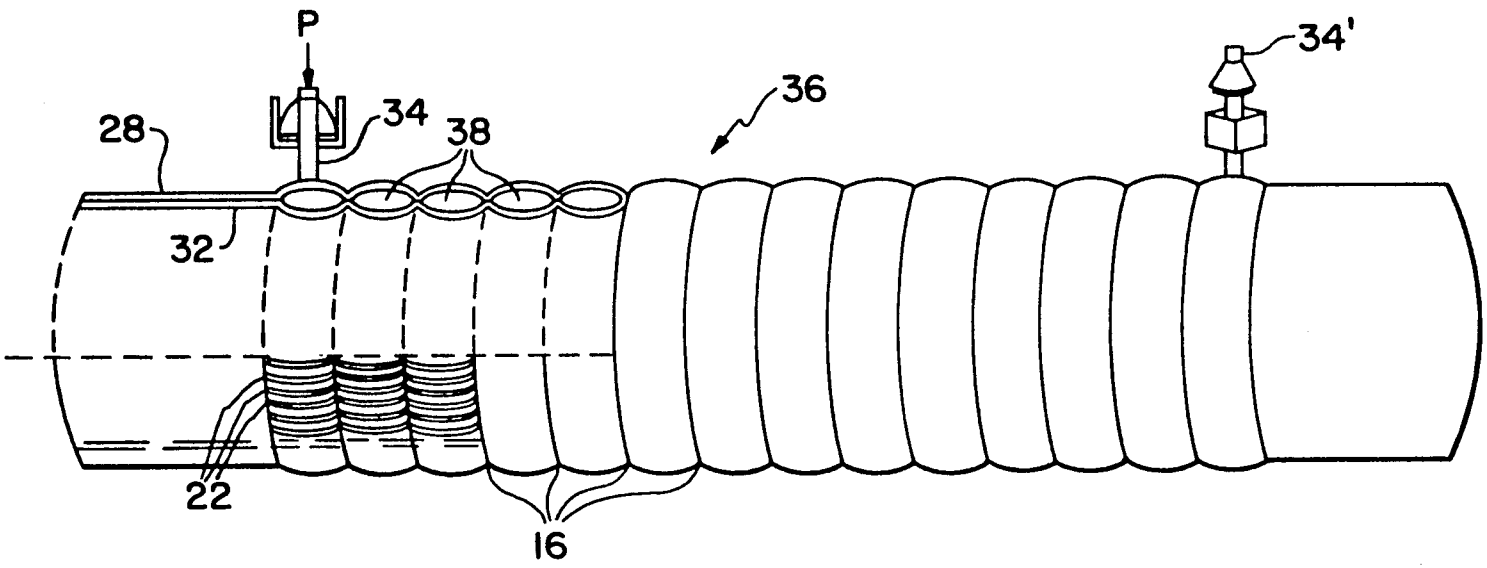
FIG. 6 is a perspective view of a manufactured ribbed flow channel in accordance with the present invention with cross-sectional portions removed to illustrate the pressure fitting and the ribs.

Referring to FIG. 6, one or more pressure fittings (34, 34') are attached to the integral cylinder (36) and hydraulic pressure is slowly applied between the welds (16) so as to deform the cylinders (28, 32). As the inner and outer cylinders (32, 28) deform under the hydraulic pressure, ribbed flow channel (38) is created. Hydraulic water pressures of about 12,000 psi are suitable for expanding the ribbed flow channel (38).

A Union Carbide Electron Beam Welder Model TC30X60 was used for the electron beam welding of the longitudinal seams (30) with the electron beam weld parameters being as follows:

TABLE 1

Long Seam Butt Weld Electron Beam Weld Parameters

| Material | 316L | IN625 |
|---|---|---|
| Thickness (in.) | .105 | .094 |
| Gun to Work (in.) | 7 | 7 |
| Beam Current (ma) | 30 | 30 |
| Beam Voltage (kv) | 55 | 55 |
| Beam Focus (Machine Setting) | +3 | 0 |
| Beam Pattern | Sine | Sine |
| Beam Amplitude (Machine Setting) | 10 | 10 |
| Beam Frequency (HZ) | 1000 | 1000 |
| Weld Speed/Gun Speed (ipm) | 30 | 60 |

The above parameters are for a stainless steel type 316L and Inconel 625 materials. The spiral welds (16) were formed on a rotating collet of the aforementioned welder as described in U.S. Pat. No. 4,295,255 which is hereby incorporated by reference. The electron beam weld parameters for welding the spiral weld (16) are set forth in Table 2.

TABLE 2

Electron Beam Welding Parameters-Spiral Weld

| Component Weld Type | Split Beam Partial Penetration | Full Penetration |
|---|---|---|
| Grade Thickness | 316L/0.105 IN625/0.094 | IN625/0.094 |
| Gun to Work (in.) | 7 | 7 |
| Beam Current (ma) | 65 | 70 |
| Beam Voltage (kv) | 55 | 55 |
| Beam Focus | Surface | Surface |
| Beam Type | Split Circle | Circle |
| Beam Amplitude | 45 | 35 |
| (Machine Setting) | 60 (dither) | — |
| Beam Frequency | 4000 | 500 |
| Square Wave (HZ) | 500 | — |
| Weld Speed (ipm) | 45 | 45 |
| Helix Lead (in.) | 1.50 | 1.50 |

TABLE 2-continued

| Electron Beam Welding Parameters-Spiral Weld | | |
|---|---|---|
| Component Weld Type | Split Beam Partial Penetration | Full Penetration |
| Gun Speed (Machine Setting ipm) | 1.32 | 1.32 |
| Work RPM (rpm) (Machine Setting) | 0.87 | 0.87 |
| Weld Width (in.) | 0.105 | 0.085 |

A pressure source P attaches to the pressure fitting (34) to supply a hydraulic pressure of about 12,000 psi which deforms the outer cylinder (28) and the inner cylinder (32) to create the ribbed flow passage (38) of the integral cylinder (36). If an additional pressure fitting (34') is employed at the opposite end of integral cylinder 36, pressure fitting (34') should be plugged during the hydraulic expansion.

Pressure fittings (34, 34') suitable for the present invention are well known and include, for example, Swagelok ® connectors.

Since the hydraulic expansion manufacturing technique produces the ribbed flow channel (38) with a diameter determined by the electron beam weld (16) spacing, there exists the added advantage of producing a variable diameter ribbed flow channel (38), merely by changing the electron beam weld (16) spacing. This variable diameter capability may be utilized for optimizing heat transfer in hydraulically expanded heat exchangers such as coiled tube boilers (10).

The integral cylinder (36) in FIG. 6 has a ribbed flow channel (38) which increases the convective heat transfer performance. The internal ribs (22) preferably are situated perpendicular or nearly perpendicular to the flow channel for increasing the convective heat transfer performance in the single phase region, that is, the subcooled water or superheated steam.

For the two-phase region which is a mixture of water and steam, the internal ribs preferably have a helix angle $\theta$ of about 50° to 70° as depicted in FIG. 8. Ribs with this angle swirl the flow which results in a water film on the inner diameter (ID) of the ribbed flow channel (38). The water film prevents the departure from nucleate boiling (DNB) and thus avoids the poor heat transfer associated with the DNB condition. Referring to FIG. 8, the range of parameters that define the geometry of internal ribs in tubing are:

$$6 \leqq P/h \leqq 25$$

$$0 \leqq s/h \leqq 2.5$$

$$0.01 \leqq WT/P \leqq 0.55$$

$$0.02 \leqq L/ID_1 \leqq 2.5$$

$$0.001 \leqq h/ID_1 \leqq 0.08$$

where:

OD=OUTSIDE DIAMETER, IN.

$ID_1$=MINOR ID, IN.

$ID_2$=MAJOR ID, IN.

$W_T$=RIB WIDTH AT TOP OF RIB PARALLEL TO LONGITUDINAL AXIS, IN.

$W_B$=RIB WIDTH AT BASE OF RIB PARALLEL TO LONGITUDINAL AXIS, IN.

$W_C$=RIB WIDTH AT TOP OF RIB PERPENDICULAR TO RIB FACES, IN.

h=RIB HEIGHT, IN.

p=PITCH, IN.

L=LEAD, IN. (distance the land of the rib advances in one revolution)

$\alpha$=ANGLE OF THE DOWNSTREAM FACE $\beta$=ANGLE OF THE UPSTREAM FACE $\theta$=LEAD ANGLE OF THE RIB $$\left(\tan\theta \approx \frac{L}{\pi d_{EFF}}\right),$$

helix angle $S=(W_B-W_T)/2$ $D_{EFF}$=EFFECTIVE DIAMETER ($=ID_1+h$), IN.

The diameter ($ID_1$) is the hydraulic diameter of the hydraulically expanded ribbed flow channel (38). The hydraulic diameter is defined as four times the cross-sectional flow area of the hydraulically expanded ribbed flow channel (38) divided by the wetted perimeter of the hydraulically expanded flow channel.

An alternate method for defining the geometry of the internal ribs in the flow channel is to have the rib height (h) no greater than eight times the laminar sublayer thickness. The laminar sublayer thickness is known in the art and is defined as:

$$\text{laminar sublayer thickness} = \frac{5 \times ID_2}{Re\sqrt{f_s 8}}$$

where:

$ID_2$=major inside diameter of flow channel

Re=the Reynolds Number (known in the art)

$f_s$=smooth-tube friction factor (known in the art)

Preferably, the ribs (22) are machined into the flat sheet metal (20) so that they are along the longitudinal axis of the cylinders as illustrated in FIGS. 4 and 5. Depending upon the helix angle, $\theta$, of the hydraulically expanded ribbed flow channel (38), the ribs (22) are either parallel to the longitudinal axis of the cylinder as seen in FIGS. 4 or 5 or at a preset angle 0 to the longitudinal axis as illustrated in FIG. 7. In an alternate embodiment of the present invention, the cylinders (28, are formed without ribs as described above. However, in this embodiment, the ribs (22) are formed after the cylinders (28, 32) are completed. The ribs (22) are made with a milling machine in a known manner. The remaining steps are otherwise the same.

The present invention provides several advantages including but not limited to the following:

a) The addition of ribs inside tubing is difficult and expensive particularly on stainless steel or high nickel alloys. In the present invention, the addition of ribs on these types of sheet metal by machining or rolling is inexpensive and easy to perform.

b) The higher inside heat transfer coefficient lowers the metal temperature of the hydraulically expanded ribbed flow channel (38) and thereby results in the possible use of thinner sheet metal to maintain the pressure boundary. This reduces the weight of a hydraulically expanded heat exchanger such as a coiled tube boiler.

c) For the same thickness of sheet metal (20), the higher inside heat transfer coefficient allows a higher outlet steam temperature. This increases power output of a coiled tube boiler.

d) Exotic and/or extremely high strength materials are more available in sheet form than in tubing. These materials may be used with the present method.

Because an inner (32) and outer cylinder (28) are used to form each coil tube boiler in accordance with the present invention, this design allows the use of different alloys for the inside (32) and the outside cylinder (28). This option is not possible with tubing. A material with high thermal conductivity, for example, could be used on the lithium reaction side (32), thus leading to higher heat transfer and reduced metal temperatures.

Use of the hydraulically expanded process may further include producing cooling channels in end caps (not shown) for the ribbed coiled tube boiler. The end caps are currently uncooled, however, by forming channels therein using the concept of the present invention, there is produced more heat transfer surface and steam production capacity.

While a specific embodiment of the invention has been shown and described in detail to illustrate the application of principles of the invention, certain modifications and improvements will occur to those skilled in the art upon reading the foregoing description. Modifications could be made to the present invention for other specific applications in heat exchangers that do not require a coiled tube boiler configuration. An example of such modifications is the utilization of the present invention in a ribbed hydraulically expanded panel wall for heat removal in furnaces, refrigerators and solar energy collectors.

It is thus understood that all such modifications and improvements have been deleted herein for the sake of conciseness and readability but are properly in the scope of the following claims.

We claim:

1. A method of manufacturing a ribbed flow channel, comprising the steps of:

ribs into two flat metal sheets;

rolling the first metal sheet to form a first cylinder having a longitudinal seam, the first metal sheet being rolled so that the ribs situated therein are positioned inside the first cylinder;

rolling the second metal sheet to form a second cylinder having a longitudinal seam, the second metal sheet being rolled so that the ribs situated therein are positioned outside the second cylinder, the second cylinder further being rolled so that it is adapted to fit concentrically within the first cylinder;

welding the longitudinal seams of both the first and second cylinders;

positioning the second cylinder inside the first cylinder;

welding in a helical path the two cylinders together to form one integral cylinder;

closing both ends of the integral cylinder with circle seam welds;

attaching a pressure fitting to one end of the integral cylinder in communication with a helical weld path; and applying a hydraulic pressure between the helical weld paths through the pressure fitting for deforming the sheets between the helical weld paths creating a ribbed flow channel.

2. A method as recited in claim 1, wherein the positioning step includes aligning lands of the ribs in one cylinder with valleys of ribs on the other cylinder.

3. A method as recited in claim 2, further comprising the step of radially expanding the second cylinder after the positioning step for obtaining a tight mechanical fit.

4. A method as recited in claim 3, wherein the forming step includes machining the ribs into the metal sheets substantially longitudinally therein.

5. A method as recited in claim 3, wherein the forming step further includes machining the ribs into the metal sheets at a predetermined angle to a longitudinal axis.

6. A method as recited in claim 5, wherein the predetermined angle orients the ribs perpendicular to the flow channel.

7. A method as recited in claim 5, wherein the predetermined angle orients the ribs at a helix angle of about 50°-70° in the flow channel.

8. A method of manufacturing a ribbed flow channel, comprising the steps of:

rolling a first metal sheet to form a first cylinder having a longitudinal seam;

rolling a second metal sheet to form a second cylinder having a longitudinal seam, said second cylinder being adapted to fit concentrically within the first cylinder;

welding the longitudinal seams of both the first and second cylinders;

forming ribs on the inside of the first cylinder and on the outside of the second cylinder;

positioning the second cylinder inside the first cylinder;

welding in a helical path the two cylinders together to form one integral cylinder;

closing both ends of the integral cylinder with circle seam welds;

attaching a pressure fitting to one end of the integral cylinder in communication with a helical weld path; and applying a hydraulic pressure between the helical weld paths through the pressure fitting for deforming the sheets between the helical weld paths creating a ribbed flow channel.

9. A method as recited in claim 8, wherein the positioning step includes aligning lands of the ribs in one cylinder with valleys of ribs on the other cylinder.

10. A method as recited in claim 9, further comprising the step of radially expanding the second cylinder after the positioning step for obtaining a tight mechanical fit.

11. A method as recited in claim 10, wherein the forming step includes milling the ribs substantially longitudinally therein.

12. A method as recited in claim 11, wherein the forming step further includes milling the ribs at a predetermined angle to a longitudinal axis.

13. A method as recited in claim 12, wherein the predetermined angle orients the ribs perpendicular to the flow channel.

14. A method as recited in claim 12, wherein the predetermined angle orients the ribs at a helix angle of about 50° to 70° in the flow channel.

15. A method of making a ribbed flow channel hydraulically expanded heat exchanger, comprising the steps of:

forming ribs into at least one metal sheet;

positioning a metal sheet on the at least one metal sheet having ribs therein, the ribs being situated between the metal sheets;

welding the metal sheets together with a plurality of weld paths for defining a plurality of channels with all of the channels being connected;

attaching a pressure fitting to at least one channel;

applying a hydraulic pressure through the pressure fitting for deforming the metal sheets with the plurality of channels for creating ribbed flow channels.

16. A method as recited in claim 15, further comprising the step of shaping the at least one metal sheet into a predetermined form prior to hydraulic expansion.

17. A method as recited in claim 15, wherein the forming step includes formings ribs into two metal sheets.

18. A method as recited in claim 17, wherein the positioning step includes aligning lands of the ribs on one metal sheet with valleys of the ribs on the other metal sheet.

* * * * *